US007922256B2

(12) United States Patent
Kammerer et al.

(10) Patent No.: US 7,922,256 B2
(45) Date of Patent: Apr. 12, 2011

(54) CIRCULAR-SHANK TOOL COMPRISING A TOOL HOLDER

(75) Inventors: Karl Kammerer, Fluorn-Winzeln (DE); Bernhard Mossmann, Schramberg-Waldmössingen (DE)

(73) Assignee: Betek Bergbau- und Hartmetalltechnik Karl-Heinz Simon GmbH & Co. KG, Aichhalden (DE)

( * ) Notice: Subject to any disclaimer, the term of this patent is extended or adjusted under 35 U.S.C. 154(b) by 336 days.

(21) Appl. No.: 12/083,510

(22) PCT Filed: Jun. 27, 2006

(86) PCT No.: PCT/EP2006/006157

§ 371 (c)(1),
(2), (4) Date: Apr. 11, 2008

(87) PCT Pub. No.: WO2007/048455

PCT Pub. Date: May 3, 2007

(65) Prior Publication Data

US 2009/0162159 A1 Jun. 25, 2009

(30) Foreign Application Priority Data

Oct. 27, 2005 (DE) ..... 10 2005 051 450

(51) Int. Cl.
*E21C 35/197* (2006.01)

(52) U.S. Cl. ..... 299/107

(58) Field of Classification Search ..... 299/102, 299/103, 106, 107; 279/43.5; 37/458
See application file for complete search history.

(56) References Cited

U.S. PATENT DOCUMENTS

| | | | | |
|---|---|---|---|---|
| 3,767,266 | A | 10/1973 | Krekeler | |
| 4,327,947 | A | 5/1982 | Bower, Jr. | |
| 4,335,921 | A | 6/1982 | Swisher, Jr. et al. | |
| 4,684,176 | A * | 8/1987 | Den Besten et al. | 299/107 |
| 4,836,614 | A | 6/1989 | Ojanen | |
| 4,921,310 | A * | 5/1990 | Hedlund et al. | 299/107 |
| 5,503,463 | A * | 4/1996 | Ojanen | 299/107 |
| 6,199,956 | B1 * | 3/2001 | Kammerer | 299/111 |
| 6,786,557 | B2 * | 9/2004 | Montgomery, Jr. | 299/104 |
| 7,380,888 | B2 * | 6/2008 | Ojanen | 299/104 |
| 2002/0153175 | A1 * | 10/2002 | Ojanen | 175/427 |
| 2006/0125308 | A1 * | 6/2006 | Sollami | 299/107 |
| 2007/0152495 | A1 * | 7/2007 | Sollami | 299/107 |

FOREIGN PATENT DOCUMENTS

DE 37 12 427 A1 10/1988

(Continued)

OTHER PUBLICATIONS

Co-Pending U.S. Appl. No. 12/083,511; filed Apr. 11, 2008; inventor Karl Kammerer; title Circular-Shank Tool Comprising A Tool Holder.

*Primary Examiner* — John Kreck
(74) *Attorney, Agent, or Firm* — Pauley Petersen & Erickson

(57) ABSTRACT

A circular-shank tool including a shank held in a bore of a tool holder by a locking sleeve, the shank being rotatably held in the locking sleeve. The locking sleeve has one or more retaining elements that project inwards and engage in a peripheral groove in the shank of the tool, thus indisplaceably securing the locking sleeve in an axial direction on the shank of the tool. Because the locking sleeve is mirror-symmetrical to the central transversal plane, the locking sleeve can be fixed to the shank in a position that is rotated through 180°.

20 Claims, 2 Drawing Sheets

FOREIGN PATENT DOCUMENTS

| | | |
|---|---|---|
| DE | 196 30 653 C1 | 4/1998 |
| DE | 197 20 635 A1 | 11/1998 |
| EP | 0 264 015 | 4/1988 |
| EP | 0 295 232 | 12/1988 |

* cited by examiner

CIRCULAR-SHANK TOOL COMPRISING A TOOL HOLDER

BACKGROUND OF THE INVENTION

1. Field of the Invention

This invention relates to a round shank chisel with a shank maintained in the bore of the chisel holder by a clamping sleeve, wherein the shank is rotatably maintained in the clamping sleeve, the clamping sleeve has one or several inwardly projecting holding elements which engage a circumferential groove cut into the shank of the round shank chisel, and the clamping sleeve is fixed in place in an axial direction on the shank of the round shank chisel so that it cannot be shifted.

2. Discussion of Related Art

In connection with such a round shank chisel with a chisel holder, the axial position of the clamping sleeve on the shank of the round shank chisel is important, so that the clamping sleeve has as little as possible axial play. Also, it is necessary for the shank of the round shank chisel to be centered by the holding devices in the clamping sleeve so that the shank is guided, freely rotatable, in the clamping sleeve braced in the bore of the chisel holder.

A round shank chisel with a chisel holder of the type mentioned at the outset is taught by European Patent Reference EP 0 264 015 A1 and German Patent Reference DE 37 12 427 A1. In this known round shank chisel, a circumferential groove in the shank of the round shank chisel, as well as the punched and/or pressed-in holding elements of the clamping sleeve, are arranged in the end section of the shank or of the clamping sleeve.

The axial position of the clamping sleeve on the shank of the round shank chisel is thus well secured, but while attaching the clamping sleeve it is necessary to assure the correct position of the front faces of the clamping sleeve. Also, the arrangement of the circumferential groove and the holding elements does not contribute to the improved centering of the shank of the round shank chisel.

SUMMARY OF THE INVENTION

It is one object of this invention to provide a chisel holder of the type mentioned above but which will ease the attachment of the clamping sleeve to the shank of the round shank chisel and also improve the centering on the shank.

This object can be achieved with each holding element arranged in the center transverse plane of the clamping sleeve, or that have the same axial distance from it. The clamping sleeve can be attached to the shank of the round shank chisel in two axial positions rotated by 180° around its longitudinal axis, and can be selectively fixed in place on it in one of the two identical positions.

With the placement of the holding elements into the center transverse plane of the clamping sleeve and the corresponding position of the circumferential groove in the shank on the round shank chisel, it is not necessary to have a correct position of the front faces of the clamping sleeve when the clamping sleeve is attached.

The same applies, for example, if two or more circumferential rows of holding elements are arranged at identical distances from the center transverse plane.

One of the identical positions of the clamping sleeve on the shank of the round shank chisel is achieved independently of the position of the clamping sleeve.

The centering of the clamping sleeve over the entire longitudinal direction is improved by this fixation and symmetrical seating of the clamping sleeve.

A rotating behavior, independent of the orientation of the clamping sleeve, can be achieved if the holding element is embodied symmetrically with respect to the center transverse plane of the clamping sleeve.

If in one embodiment the outer edges at the two front faces of the clamping sleeve are slanted, the introduction of the round shank chisel with the clamping sleeve attached to the shank into the bore of the chisel holder is simplified. In one embodiment, the slanted outer edges of the front faces of the clamping sleeve are located at an angle of approximately 30° to 60° with respect to the outer wall of the clamping sleeve in order to allow a dependable insertion of the clamping sleeve into a corresponding receptacle of a chisel holder.

For reducing the axial play of the clamping sleeve on the shank of the round shank chisel to a minimum, in a further embodiment the holding elements are divided between two punched edges which are oriented transversely to the longitudinal axis of the clamping sleeve and are inwardly punched and/or pressed. The punched edges extend over a portion of the circumference of the clamping sleeve and have a distance from each other which is equal to or less than the width of the circumferential groove in the shank of the round shank chisel. For reducing the radial play, the holding elements form a coaxial, concave centering section facing the convex groove bottom of the circumferential groove.

The concave centering section of the holding elements thus formed assures a good centering of the shank in the clamping sleeve.

The holding elements can be designed so that the clamping element has three holding elements, of which one holding element is located opposite the slit in the clamping sleeve, and the other two holding elements are each offset with respect to the one holding element by approximately 100° on a circumference of the clamping sleeve. A width of the circumferential groove, and thus the associated width of the holding elements, is selected to be approximately ⅙ to ⅓ of the axial dimension of the clamping sleeve. In this case, the concave centering sections of the holding elements extend for example over an angular area of approximately 30° to 50° of the circumference of the clamping sleeve in order to obtain stable seating.

So that no sharp edges are created at the punched and/or pressed-in holding elements, which could hamper the free rotatability of the shank of the round shank chisel, in one embodiment of the holding elements the ends of the concave centering sections of the holding elements transition via a convex curved portion into a transition section, which makes a transition via a concave curved portion into the interior wall of the clamping sleeve. Also, the convex outer sections of the clamping sleeve located opposite the concave centering sections transition at their ends via a concave curved portion, a transition section and a convex curved portion into the outer wall of the clamping sleeve, and the holding elements are inwardly punched and/or pressed in so far that the convex outer sections located opposite the concave centering sections are spaced apart from the inner wall of the clamping sleeve. A depth of the circumferential groove in the shank of the round shank chisel has such dimensions that, in the clamped state of the clamping sleeve, the concave centering sections of the holding elements are at a short distance from the groove bottom of the circumferential groove.

Finally, if the front face of the clamping sleeve facing the chisel tip is spaced apart from the conical introduction section of the bore in the chisel holder which receives a conical shoulder of the chisel head or a centering shoulder of a wear disk arranged between the chisel holder and the chisel head, this front face of the clamping sleeve is also freed.

BRIEF DESCRIPTION OF THE DRAWINGS

This invention is explained in greater detail in view of one embodiment represented in the drawings, wherein.

DETAILED DESCRIPTION OF THE INVENTION

Figure 1:
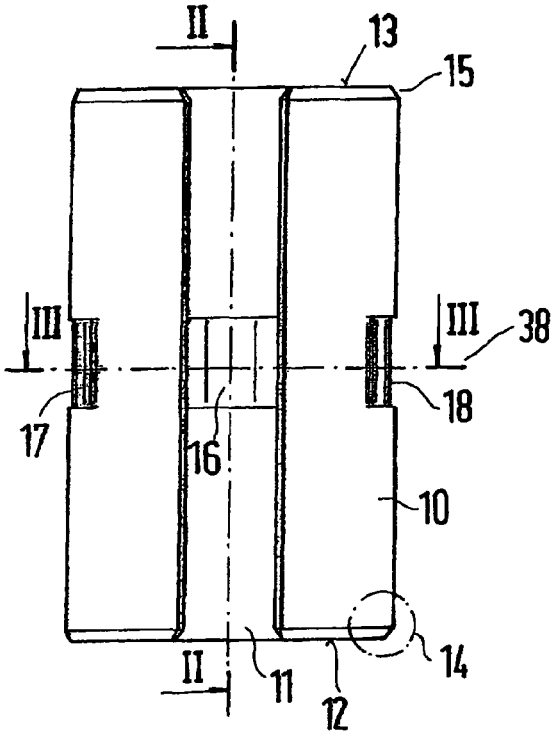
FIG. 1 is a lateral plan view of a clamping sleeve in a view on the slit thereof, according to one embodiment of this invention.
Figure 2:
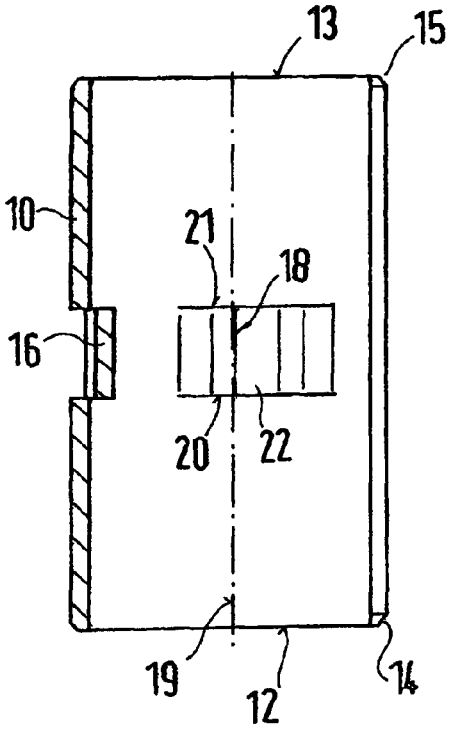
FIG. 2 is a longitudinal sectional view taken through the clamping sleeve along line II-II shown in FIG. 1.
Figure 3:
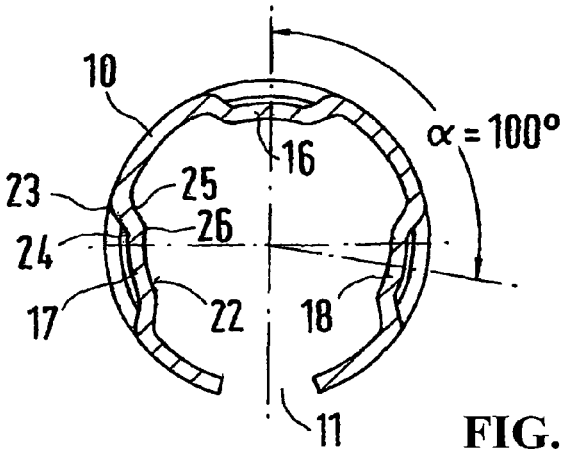
FIG. 3 is a cross-section taken through the clamping sleeve along the line III-III shown in FIG. 1.

The clamping sleeve 10 in accordance with FIGS. 1 to 3 has the longitudinally extending slit 11, in which the outer edges 14 and 15 of the front faces 12 and 13 are slanted. The slanted outer edges 14 and 15 extend at an angle of approximately 30° with respect to the outer wall of the clamping sleeve 10, so that these do not hamper introduction into a conical insertion section 42 of a bore 41 in a chisel holder 40, such as shown in FIG. 4.

The outer edges 14 and 15 are slanted on both front faces 12 and 13, because the clamping sleeve 10 can face the insertion section 42 with either one of the two front faces 12 and 13.

The holding elements 16, 17 and 18 are arranged in the area of or near the center transverse plane 38 of the clamping sleeve 10 and are designed symmetrically with respect to it.

Figure 4:
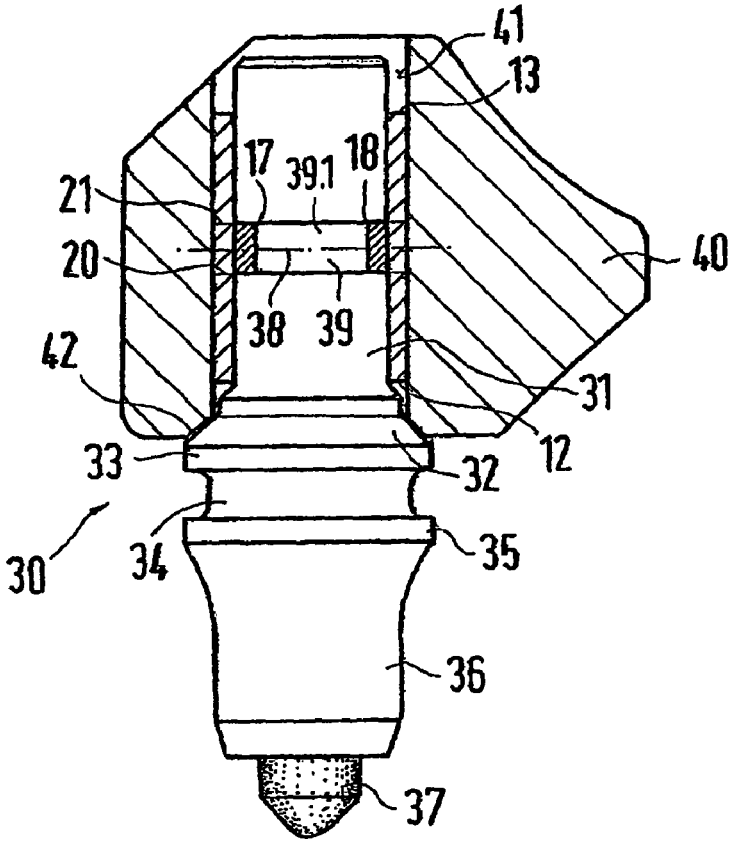
FIG. 4 is a partial longitudinal section taken through a round shank chisel with a chisel holder, in which a novel clamping sleeve in accordance with FIGS. 1 to 3 is attached to the shank and is introduced into the bore of the chisel holder.

As shown in FIG. 4, a circumferential groove 39 is cut into the shank 31 of the round shank chisel 30, made in such a way that the clamping sleeve 10 can be fixed in place on the shank 31 in one of the two axial positions in which the holding elements 16, 17 and 18 engage the circumferential groove 39. Because the clamping sleeve 20 is embodied mirror-reversed with respect to the center transverse plane 38, it can be fixed in place rotated by 180° on the shank 31. This makes the application easier, because it is no longer required to pay attention to the correct position with respect to the shank 31, such as with conventional round shank chisels. Thus, the novel clamping sleeve 10 can take up one of two identical positions on the shank 31. By matching the holding elements 16, 17 and 18, and the circumferential groove 39 in the shank 31, the front face 12 facing the chisel tip 37 does also not project into the conical insertion section 42 of the bore 41 in the chisel holder 40 and is freed, such as shown in FIG. 4. The chisel head 36 projects into the conical insertion section 42 with a conical shoulder 32 of the collar 33, which is followed by the pull-off groove 34 and the pull-off collar 35 of the chisel head 36 with the inserted chisel tip 37.

As FIGS. 1 to 3 show, the clamping sleeve 10 has three holding elements 16, 17 and 18 distributed over the circumference. The one holding element 16 is located opposite the slit 11. The other two holding elements 17 and 18 are arranged on the circumference of the clamping sleeve 10, offset at an angle X of approximately 100° with respect to the one holding element 16.

The holding elements 16, 17 and 18 are spaced apart by two parallel punched edges 20 and 21, which are oriented transversely with respect to the longitudinal axis 19 of the clamping sleeve 10 and extend over an angular area of 50° to 60° of the circumference of the clamping sleeve 10.

Facing the groove bottom of the circumferential groove 39, the punched-in and/or pressed-in holding elements 16, 17 and 18 form a coaxial, concave centering section 22, which includes an angular area of approximately 30° to 50°.

With their ends, the centering sections 22 of the holding elements 16, 17 and 18 transition into the inner wall of the clamping sleeve 10 via a convex curved portion 26, a transition section and a concave curved portion 25. The convex outer sections located opposite the concave centering sections 22 transition at both ends into the outer wall of the clamping sleeve 10 via a concave curved portion 25, a transition section and a convex curved portion 23.

The holding elements 16, 17 and 18 can be, shaped, punched and/or pressed inward so far that, in the braced state of the clamping sleeve 10 in the bore 41 of the chisel holder 40, with the concave centering sections 22, they are at a slight distance from the convex groove bottom 39.1 of the circumferential groove 39. The depth of the circumferential groove can be laid out accordingly and can further have such dimensions that the convex outer sections of the holding elements 16, 17 and 18 are spaced apart from the inner wall of the clamping sleeve 10, as shown in the cross section of FIG. 3.

The chisel head 36 can be supported on a wear disk, which rests against the front side of the chisel holders 40 and projects with a centering shoulder into the conical insertion section 42 of the chisel holder 40.

The centering shoulder of the wear disk then does not contact the facing front side of the clamping sleeve 10 attached to the shank 31 of the round shank chisel 30, and cannot hamper the rotational mobility of the shank 31.

The invention claimed is:

1. A round shank chisel (30) with a shank (31), wherein the shank (31) is rotatably maintained in a clamping sleeve (10), the clamping sleeve (10) has at least one inwardly projecting holding element (16, 17, 18) which engages a circumferential groove (39) cut into the shank (31) of the round shank chisel (30), the clamping sleeve (10) is fixed in an axial direction on the shank (31) of the round shank chisel (30) so that the clamping sleeve (10) cannot be shifted, each of the at least one holding element (16, 17, 18) is arranged in a center transverse plane (38) of the clamping sleeve (10) or a same axial distance from the center transverse plane (38), and the clamping sleeve (10) is attachable to the shank (31) of the round shank chisel (30) in two axial positions rotated by 180° around a longitudinal axis (19), and is selectively fixable in place in one of the two positions, the clamping sleeve comprising:

the holding elements (16, 17, 18) spaced apart by two parallel punched edges (20, 21) oriented transversely with respect to the longitudinal axis (19) of the clamping sleeve (10) and are inwardly punched or pressed, and the punched edges (20, 21) extend over a portion of a circumference of the clamping sleeve (10) and have a distance from each other which is equal to or less than a width of the circumferential groove (39) in the shank (31) of the round shank chisel (30).

2. The round shank chisel in accordance with claim 1, wherein the at least one holding element 16, 17, 18) is symmetrical with respect to the center transverse plane (38) of the clamping sleeve (10).

3. The round shank chisel in accordance with claim 2, wherein outer edges (14, 15) at both front faces (12, 13) of the clamping sleeve (10) are slanted.

4. The round shank chisel in accordance with claim 3, wherein the slanted outer edges (14, 15) of the clamping sleeve (10) are located at an angle of 10° to 60° with respect to the outer wall of the clamping sleeve (10).

5. The round shank chisel in accordance with claim 4, wherein the at least one holding element (16, 17, 18) each forms a coaxial, concave centering section (22) facing a convex groove bottom of the circumferential groove (39).

6. The round shank chisel in accordance with claim 5, wherein the clamping element (10) has three of the holding elements (16, 17, 18) of which one holding element (16) is located opposite a slit (11) in the clamping sleeve (10), and the other two holding elements (17, 18) are each offset with respect to the one holding element (16) by approximately 100° on a circumference of the clamping sleeve (10).

7. The round shank chisel in accordance with claim 6, wherein a width of the circumferential groove (39) and an associated width of the holding elements (16, 17, 18) is approximately ⅙ to ⅓ of an axial dimension of the clamping sleeve (10).

8. The round shank chisel in accordance with claim 7, wherein the concave centering section (22) of each of the holding elements (16, 17, 18) extends over an angular area of approximately 30° to 50° of a circumference of the clamping sleeve (10).

9. The round shank chisel in accordance with claim 8, wherein ends of the concave centering sections (22) of the holding elements (16, 17, 18) transition via a convex curved portion (28) into a transition section which makes a transition via a concave curved portion (25) into an interior wall of the clamping sleeve (10), and the convex outer sections of the clamping sleeve (10) located opposite the concave centering sections (22) transition at ends via a concave curved portion (24), a transition section and a convex curved portion (23) into an outer wall of the clamping sleeve (10).

10. The round shank chisel in accordance with claim 9, wherein the holding elements (16, 17, 18) are inwardly punched or pressed so far that the convex outer sections located opposite the concave centering sections (22) are spaced apart from the inner wall of the clamping sleeve (10), and the depth of the circumferential groove (39) in the shank (31) of the round shank chisel (30) has dimensions so that with the clamping sleeve (10) braced in a bore (41) of a chisel holder (40), the concave centering sections (22) of the holding elements (16, 17, 18) rest against or are a short distance from the groove bottom of the circumferential groove (39).

11. The round shank chisel in accordance with claim 8, wherein the front face (12) of the clamping sleeve (10) facing a chisel tip (37) is spaced apart from a conical introduction section (42) of the bore (41) in a chisel holder (40) which receives a conical shoulder (32) of a chisel head (36) or a centering shoulder of a wear disk arranged between the chisel holder (40) and the chisel head (36).

12. The round shank chisel in accordance with claim 1, wherein outer edges (14, 15) at both front faces (12, 13) of the clamping sleeve (10) are slanted.

13. The round shank chisel in accordance with claim 12, wherein the slanted outer edges (14, 15) of the clamping sleeve (10) are located at an angle of 10° to 60° with respect to the outer wall of the clamping sleeve (10).

14. The round shank chisel in accordance with claim 1, wherein the at least one holding element (16, 17, 18) each forms a coaxial, concave centering section (22) facing a convex groove bottom of the circumferential groove (39).

15. The round shank chisel in accordance with claim 1, wherein the clamping element (10) has three of the holding elements (16, 17, 18) of which one holding element (16) is located opposite the slit (11) in the clamping sleeve (10), and the other two holding elements (17, 18) are each offset with respect to the one holding element (16) by approximately 100° on a circumference of the clamping sleeve (10).

16. The round shank chisel in accordance with claim 1, wherein a width of the circumferential groove (39) and an associated width of the holding elements (16, 17, 18) is approximately ⅙ to ⅓ of an axial dimension of the clamping sleeve (10).

17. The round shank chisel in accordance with claim 5, wherein the concave centering section (22) of each of the holding elements (16, 17, 18) extends over an angular area of approximately 30° to 50° of a circumference of the clamping sleeve (10).

18. The round shank chisel in accordance with claim 5, wherein ends of the concave centering sections (22) of the holding elements (16, 17, 18) transition via a convex curved portion (28) into a transition section which makes a transition via a concave curved portion (25) into an interior wall of the clamping sleeve (10), and the convex outer sections of the clamping sleeve (10) located opposite the concave centering sections (22) transition at ends via a concave curved portion (24), a transition section and a convex curved portion (23) into an outer wall of the clamping sleeve (10).

19. The round shank chisel in accordance with claim 5, wherein the holding elements (16, 17, 18) are inwardly punched or pressed so far that the convex outer sections located opposite the concave centering sections (22) are spaced apart from the inner wall of the clamping sleeve (10), and the depth of the circumferential groove (39) in the shank (31) of the round shank chisel (30) has dimensions so that with the clamping sleeve (10) braced in a bore (41) of a chisel holder (40), the concave centering sections (22) of the holding elements (16, 17, 18) rest against or are a short distance from the groove bottom of the circumferential groove (39).

20. A clamping sleeve for a shank (31) of a round shank chisel (30), comprising:

more than one inwardly projecting holding element (16, 17, 18) which engages a circumferential groove (39) cut into the shank (31) of the round shank chisel (30), wherein the clamping sleeve (10) is fixed in an axial direction on the shank (31) of the round shank chisel (30) so that the clamping sleeve (10) cannot be shifted, each of the more than one holding element (16, 17, 18) is arranged in a center transverse plane (38) of the clamping sleeve (10) or a same axial distance from the center transverse plane (38), and the clamping sleeve (10) is attachable to the shank (31) of the round shank chisel (30) in two axial positions rotated by 180° around a longitudinal axis (19), and is selectively fixable in place in one of the two positions;

the more than one holding elements (16, 17, 18) formed between two parallel punched edges (20, 21) oriented transversely with respect to the longitudinal axis (19) of the clamping sleeve (10) and are inwardly punched or pressed, wherein the punched edges (20, 21) extend over a portion of a circumference of the clamping sleeve (10) and have a distance from each other which is equal to or less than a width of the circumferential groove (39) in the shank (31) of the round shank chisel (30).

* * * * *